US006814828B1

(12) United States Patent
Huebner

(10) Patent No.: US 6,814,828 B1
(45) Date of Patent: Nov. 9, 2004

(54) METHOD AND DEVICE FOR PRODUCING MELT-SPUN CONTINUOUS THREADS

(75) Inventor: Diethard Huebner, Bordesholm (DE)

(73) Assignee: Neumag GmbH & Co., Neumuenster (DE)

( * ) Notice: Subject to any disclaimer, the term of this patent is extended or adjusted under 35 U.S.C. 154(b) by 201 days.

(21) Appl. No.: 09/979,957

(22) PCT Filed: Jun. 28, 2000

(86) PCT No.: PCT/EP00/06008

§ 371 (c)(1),
(2), (4) Date: Nov. 27, 2001

(87) PCT Pub. No.: WO01/02633

PCT Pub. Date: Jan. 11, 2001

(30) Foreign Application Priority Data

Jun. 30, 1999 (DE) ..... 199 29 817

(51) Int. Cl.[7] ..... B32B 31/00

(52) U.S. Cl. ..... 156/167; 156/296; 156/433; 156/441; 156/148

(58) Field of Search ..... 156/167, 166, 156/180

(56) References Cited

U.S. PATENT DOCUMENTS 3,427,192 A * 2/1969 Bolinger ..... 427/334
4,995,884 A 2/1991 Ross et al.
5,350,529 A 9/1994 Day
6,085,395 A * 7/2000 Weiss ..... 28/221

FOREIGN PATENT DOCUMENTS

| | | | |
|---|---|---|---|
| DE | 37 35 752 A1 | | 5/1988 |
| DE | 196 49 809 A | | 6/1997 |
| EP | 0 485 871 A1 | | 5/1992 |
| EP | 0 784 109 A2 | | 7/1997 |
| GB | 1 066 697 A | | 4/1967 |
| JP | 60-246808 A | * | 12/1986 |

OTHER PUBLICATIONS

Patent Abstracts of Japan 60 –246808 Dec. 6, 1985, May 6, 1986, 10/No. 12.

Patent Abstracts of Japan 61–28010 Feb. 7, 1986, Jun. 21, 1986 vol. 19/No.

* cited by examiner

*Primary Examiner*—Jeff H. Aftergut
(74) *Attorney, Agent, or Firm*—Michael J. Striker

(57) ABSTRACT

A method and device for producing melt-spun continuous threads includes two preparers spaced apart from one another, at each of which a partial quantity of a preparation is applied to the threads. A first preparation is performed upstream of a first draw-off device and a second downstream of the first draw-off device. As a result, high cohesion of the filaments in the thread is achieved.

7 Claims, 2 Drawing Sheets

METHOD AND DEVICE FOR PRODUCING MELT-SPUN CONTINUOUS THREADS

BACKGROUND OF THE INVENTION

The invention relates to a method and device for producing melt-spun continuous threads.

In the production of melt-spun continuous threads, the problem exists that the threads that are not further treated come apart as they are drawn off and drafted on the galettes; that is, the individual filaments come apart, and individual threads mix with one another. This has an adverse effect on the smooth travel of the thread, the maximum possible capacity of a galette, and in multicolor threads, the clarity of the individual colors.

From European Patent Disclosure EP 0 485 871 B1, a method and a device have become known in which differently dyed partial threads, after a preparation, are individually precompacted, drafted individually on galettes, and then jointly textured, compacted, and wound onto a bobbin; the precompacting is reversed again during the drafting. The goal of the precompacting is said to be that the partial threads have a certain cohesion during processing, and the finished yarn has clearly distinguishable colors.

In European Patent Disclosure EP 0 784 109 A2, a method and a device for creating a multicolor yarn are described, in which differently dyed partial threads or partial threads to be dyed differently are treated in such a way that before a final compacting done jointly, the partial threads are separated again, individually subjected to a further so-called postcompacting, then united, compacted and wound onto a bobbin. Once again, the goal is to attain compactness of the partial threads and different colors in the yarn.

The known methods have a number of disadvantages. Compacting is usually done by means of compressed air; this type of energy is very expensive, so that the production costs for the threads increase sharply with the number of compacting operations. A first compactor is disposed immediately downstream of the preparer; the effect is that by the compacting, some of the preparation agent is forced out of the thread and thus lost to the production process. Also, this portion of the preparation agent is atomized because of the action of the compressed air; because this presents a health risk to workers and a risk to the environment, this mist must be caught and disposed of. Finally, the knots created by the compacting lead to nonhomogeneity and interfere with the drafting.

SUMMARY OF THE INVENTION

The invention is suitable for producing various yarn qualities, such as BCF (carpet fiber; textile fibers, industrial yarns) and FDY. The process includes at least the steps of spinning and cooling the filaments as well as preparation and drawing off of the filaments combined into partial threads. Depending on the later use, such steds as drafting, texturing, compacting, bobbin winding, and so forth are added either individually or in combination. In these remarks, "filament" describes a single fiber, while "thread" and "yarn" mean many filaments, joined together. A thread or yarn can be assembled from a plurality of partial threads that are processed separately before being joined together.

The object of the invention is to disclose a method for producing melt-spun continuous threads, in which with minimal use of aids such as compressed air and preparation agent, optimal thread travel on the galettes is attained with simultaneous high capacity, better performance in further handling steps such as drafting and texturing, and in the case of multicolor threads, high color contrast. Another object is to create a device for performing the method of the invention.

The preparation of a thread is performed in at least two stations, which are spaced apart from one another, in each case with a partial quantity of the total preparation agent required; the second preparer is disposed downstream of the first draw-off device. The preparation agent that is applied at a first station accordingly has enough time to penetrate far into the thread and to be distributed in it; this process is reinforced especially at the deflection at the draw-off device, where the thread undergoes fulling. The second preparer has the effect that the preparation agent overall can be applied maximally uniformly to the entire surface of all the filaments, without any substantial excess. This promotes the heat transfer between the thread and galettes as well as the further processing, such as drafting. A thread maintains a compact shape without coming apart. As a result, it is possible for many threads to be drawn over one galette, and/or to use a high wrap number, without requiring compacting. At the same time, very high thread speeds are possible. The risk of filament breakage is reduced.

Disposing the second preparer immediately upstream of the drafting has the advantage that an optimal heat transfer on the galettes can be achieved.

Limiting the quantity of preparation agent prevents losses and environmental impairment from ejection of the agent from the thread.

The preparation agents with an optimal effect for the subsequent method steps can be employed.

Claim 5 attains the second object.

BRIEF DESCRIPTION OF THE DRAWINGS

The drawings serve to explain the invention in terms of exemplary embodiments shown in simplified, schematic form.

DETAILED DESCRIPTION OF THE PREFERRED EMBODIMENTS

Figure 1:
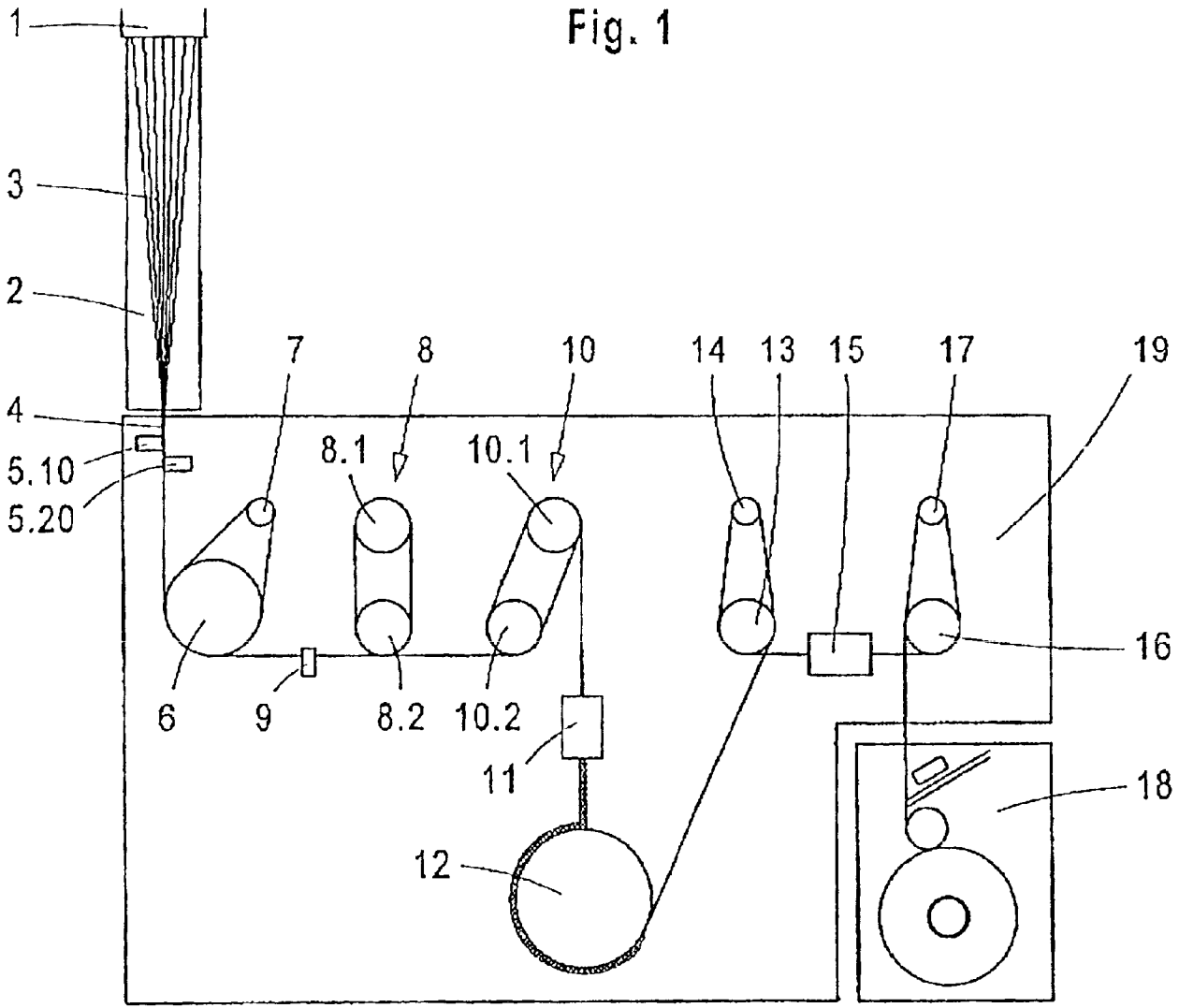
FIG. 1 shows a device for producing a melt-spun continuous thread.

In the device shown in FIG. 1, immediately under a nozzle plate 1 is a spinning chute 2, in which the filaments 3 leaving the nozzle plate 1 are cooled. Many filaments 3 are combined into one thread 4 before being further treated. A first preparer 5, which can be assembled from a plurality of preparation stations 5.10, 5.20 disposed immediately one after the other, is disposed downstream of the spinning chute 2. The prepared thread 4 wraps multiple times, such as from 1.5 to 2 times, around a drivable galette 6 and a deflection roller 7. The galette 6 and deflection roller 7 form the first draw-off device. Between the galette 6 and a first pair 8 of galettes, a second preparer 9 is provided. The pair 8 of galettes comprises two vertically spaced-apart galettes 8.1, 8.2, which can each be driven and heated, and the thread 4 wraps around them multiple times, for instance from 5 to 13 times. Downstream of it is a second pair 10 of galettes, and once again the thread 4 wraps around them multiple times. The associated galettes 10.1, 10.2 are each drivable and are spaced apart both horizontally and vertically. Downstream of the galette 10.1 is a texturer 11, followed by a drivable cooling roller 12. Downstream of the cooling roller 12, the thread 4 passes via a drivable galette 13 and a deflection roller 14 to reach the compactor 15. The thread 4 is then guided over the drivable galette 16 and the deflection roller 17 to the bobbin winder 18. The entire device, beginning with the first preparer 5 but without the bobbin winder 18, is expediently mounted on a frame 19.

In operation, molten plastic is forced through the nozzle plate 1 and spun into filaments 3. The filaments are cooled in the spinning chute 2, for instance by a stream of air, so that the plastic of the filaments 3 solidifies. The filaments 3 combined into a thread 4 are moistened with preparation agent in the first preparer 5; the quantity of preparation agent is about 75% of the total quantity required, for instance. The preparation agent has the effect that during further processing, the thread 4 is maximally compact, and that a good heat transfer is attained between the thread and the galette, for instance. The thread 4 is drawn off via the galette 6 and the deflector 7 and delivered to the second preparer 9. Since the preparation agent that was applied in the first preparer 5 was able to penetrate far into the thread 4, it is now possible for the missing quantity of preparation agent for optimal further processing to be applied without requiring any significant excess. It is also possible to use a second preparation agent. The thread is then drafted in a known manner by the pairs 8, 10 of galettes, crimped in the texturer 11, cooled on the cooling roller 12, tangled in the compactor 15, and finally wound onto bobbins by means of the bobbin winding machines 18. The galettes 13, 16 with the deflection rollers 14, 17 each serve to draw off the thread 4.

Depending on the intended purpose of the thread 4, the device can be supplemented with further devices or shortened by some treatment steps.

Figure 2:
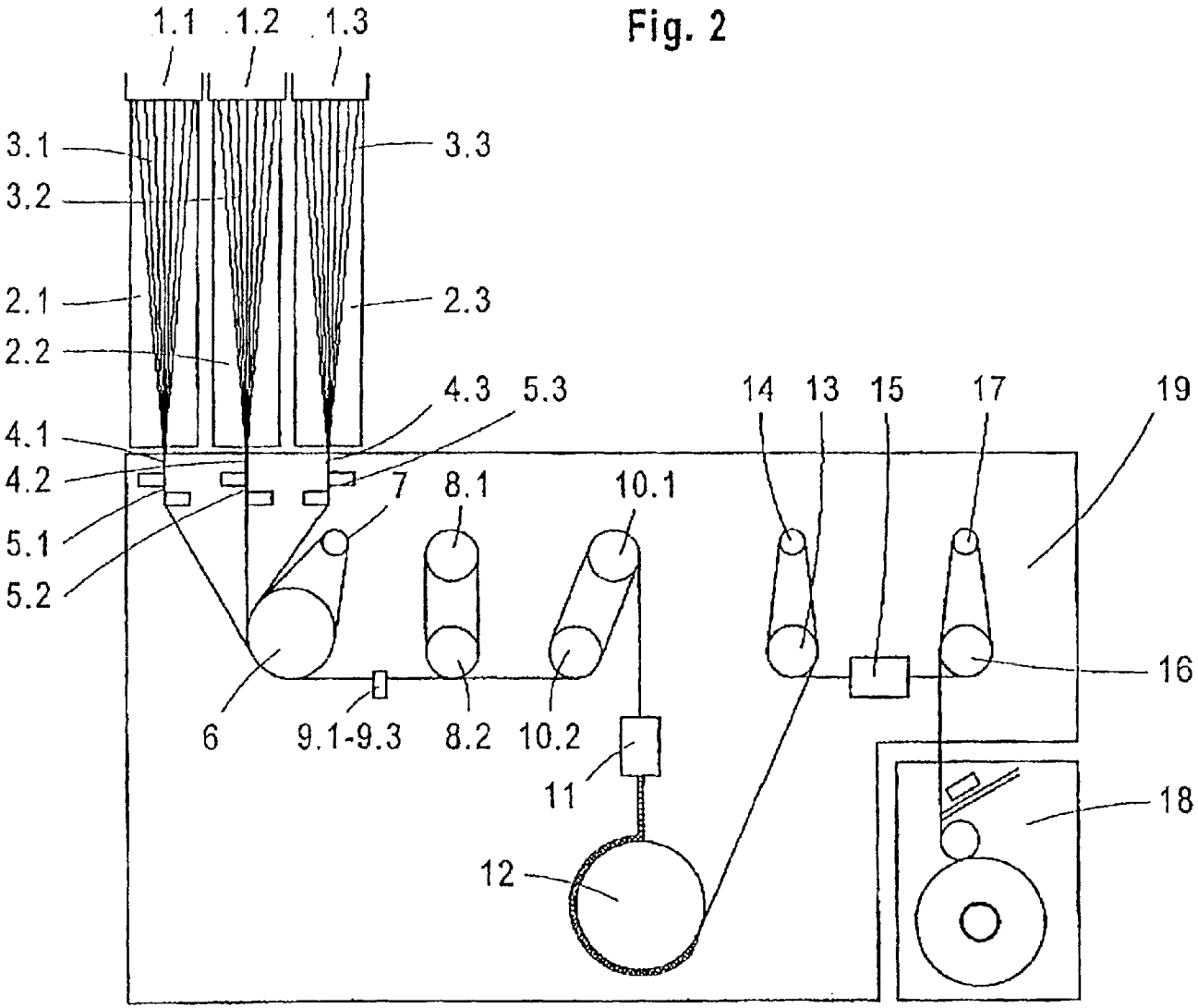
FIG. 2 shows a variant of FIG. 1 for producing a multicolor yarn.

For producing a multicolor yarn, FIG. 2 shows a device for three colors as an example. The filaments 3.1, 3.2, 3.3, dyed differently or to be dyed differently, each travel, after emerging from the spinneret 1.1, 1.2, 1.3, directly into a spinning chute 2.1, 2.2, 2.3 and are then joined into three individual threads 4.1, 4.2, 4.3, respectively. Each individual thread 4.1, 4.2, 4.3 is assigned a first preparer 5.1, 5.2, 5.3 below the spinning chute 2.1, 2.2, 2.3. The first preparer 5.1, 5.2, 5.3 can be assembled from a plurality of preparation stations immediately in line with one another. The further layout of the device is as in the description of FIG. 1, with the exception that for each individual thread 4.1, 4.2, 4.3, a separate second preparer 9.1, 9.2, 9.3 is provided.

The mode of operation is essentially in accordance with the above descriptions. The various threads 4.1, 4.2, 4.3 dyed differently or to be dyed differently are kept separate until before the texturer 11, so that a separate treatment takes place in each case. This is assured on the one hand by a suitable thread guidance and on the other by the compactness of a thread 4.1, 4.2, 4.3 as a consequence of the preparation. The threads 4.1, 4.2, 4.3 are then, as described above, preferably jointly textured, cooled, compacted and wound onto bobbins.

The devices shown as examples in FIGS. 1 and 2 can also be embodied such that a plurality of threads, for instance two, four, six or eight threads, can be processed simultaneously and in parallel.

List of Reference Numerals

1. Nozzle plate
2. Spinning chute
3. Filament
4. Thread
5. First preparer
6. Galette
7. Deflection roller
8. Pair of galettes
9. Second preparer
10. Pair of galettes
11. Texturer
12. Cooling roller
13. Galette
14. Deflection roller
15. Compactor
16. Galette
17. Deflection roller
18. Bobbin winder
19. Frame

What is claimed is:

1. A method for producing melt-spun, continuous, multicolor threads from a plurality of filaments, wherein differently dyed or dyeable filaments are combined in groups of at least two threads and are drawn off, the method comprising at least the following steps:

performing first a preparation of the threads with a preparation agent at least before a first draw-off device;

stretching the threads;

texturing the threads, wherein the threads are crimped;

cooling the threads;

compacting the threads without precompaction after the first preparation; and winding the threads, wherein at least a second preparation is performed after the first draw-off device and before the stretching.

2. The method of claim 1, wherein the filaments are held separately inclusive of the stretching, then are combined as thread and commonly textured, cooled, compacted, and wound.

3. The method of claim 1, wherein in the first preparation, precisely enough preparation agent is applied that good travel on the first draw-off device is assured.

4. The method of claim 1, wherein in the first preparation and the second preparation, different preparation agents are employed.

5. A device for producing melt-spun, continuous, multicolor threads from a plurality of filaments, wherein differently colored or colorable filaments are combined in groups of at least two threads, comprising:

a draw-off device, comprising a galette and a deflection roller;

a first preparer arranged before the draw-off device;

first and second galette pairs, wherein the threads are stretched between the galette pairs;

a texturing device;

a cooling roller;

a compacting device arranged without a precompacting device after the first preparer; and a winding device, wherein a second preparer is arranged between the draw-off device and the first galette pair.

6. The device of claim 5, wherein the each thread is separately arranged.

7. The device of claim 5, wherein the first preparer can comprise two immediately adjacent preparation stations.

* * * * *